US007322494B1

(12) United States Patent
Hicks

(10) Patent No.: US 7,322,494 B1
(45) Date of Patent: Jan. 29, 2008

(54) COLLAPSA-CAN

(76) Inventor: Adrian Hicks, 1615 Hotel Cir. South #D-101, San Diego, CA (US) 92108

( * ) Notice: Subject to any disclaimer, the term of this patent is extended or adjusted under 35 U.S.C. 154(b) by 413 days.

(21) Appl. No.: 11/141,779

(22) Filed: May 31, 2005

Related U.S. Application Data

(60) Provisional application No. 60/600,174, filed on Aug. 11, 2004.

(51) Int. Cl.
*B67D 3/00* (2006.01)

(52) U.S. Cl. ..... 222/539; 222/92; 383/904

(58) Field of Classification Search ..... 222/539, 222/92, 95, 100, 105, 106, 526; 383/104, 383/107, 119, 27, 88, 904; 229/248, 125.04, 229/108.1
See application file for complete search history.

(56) References Cited

U.S. PATENT DOCUMENTS 1,833,675 A * 11/1931 Geimer ..... 383/211
2,070,783 A * 2/1937 Conner ..... 222/539
3,367,380 A * 2/1968 Dickey ..... 383/104
3,595,441 A * 7/1971 Grosjean ..... 222/107
3,958,729 A * 5/1976 Martin ..... 222/539
4,781,314 A * 11/1988 Schoonover et al. ..... 222/465.1
5,174,458 A * 12/1992 Segati ..... 215/383
5,731,021 A * 3/1998 Spector ..... 426/111
5,862,940 A 1/1999 Chism
6,036,061 A * 3/2000 O'Donnell ..... 222/539
6,039,210 A * 3/2000 Flowers ..... 222/1
6,047,848 A 4/2000 Davis
6,105,821 A * 8/2000 Christine et al. ..... 222/105
6,209,781 B1 * 4/2001 Sylvester et al. ..... 229/110
6,334,543 B1 1/2002 Abbondandolo
6,877,654 B2 * 4/2005 Bartlett et al. ..... 229/125.15

* cited by examiner

*Primary Examiner*—Lien M. Ngo

(57) ABSTRACT

A collapsible fuel container can that is used to store a small quantity of gasoline or other fuel. The collapsible fuel container can be flattened by pushing the sides together, causing the collapsible fuel container to compactly fold. The collapsible fuel container also has a two-way spout which can be used to assist an individual in filling the collapsible fuel container with fuel or with dispensing an amount of fuel from the collapsible fuel container.

3 Claims, 2 Drawing Sheets

COLLAPSA-CAN

I. CROSS-REFERENCE TO RELATED APPLICATIONS

This application claims the benefit of U.S. Provisional Application No. 60/600,174 filed Aug. 11, 2004.

II. BACKGROUND OF THE INVENTION

The present invention concerns that of a collapsible gas can that is used to store a small quantity of gasoline or other fuel.

III. DESCRIPTION OF THE PRIOR ART

U.S. Pat. No. 6,334,543, issued to Abbondandolo, discloses a foldable, collapsible pleated container for storage in a vehicle and used for transporting gasoline.

U.S. Pat. No. 5,862,940, issued to Chism and U.S. Pat. No. 6,047,848, issued to Davis, disclose additional portable collapsible containers for carrying gasoline.

IV. SUMMARY OF THE INVENTION

The present invention concerns that of a collapsible fuel container can that is used to store a small quantity of gasoline or other fuel. The collapsible fuel container can be flattened by pushing the sides together, causing the collapsible fuel container to compactly fold. The collapsible fuel container also has a two-way spout which can be used to assist an individual in filling the collapsible fuel container with fuel or with dispensing an amount of fuel from the collapsible fuel container.

There has thus been outlined, rather broadly, the more important features of a collapsible fuel container can that the detailed description thereof that follows may be better understood and in order that the present contribution to the art may be better appreciated. There are, of course, additional features of the collapsible fuel container can that will be described hereinafter and which will form the subject matter of the claims appended hereto.

In this respect, before explaining at least one embodiment of the collapsible fuel container can in detail, it is to be understood that the collapsible fuel container can is not limited in its application to the details of construction and to the arrangements of the components set forth in the following description or illustrated in the drawings. The collapsible fuel container can is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present collapsible fuel container can. It is important, therefore, that the claims be regarded as including such equivalent constructions insofar as they do not depart from the spirit and scope of the present invention.

It is therefore an object of the present invention to provide a collapsible fuel container can which has all of the advantages of the prior art and none of the disadvantages.

It is another object of the present invention to provide a collapsible fuel container can which may be easily and efficiently manufactured and marketed.

It is another object of the present invention to provide a collapsible fuel container can which is of durable and reliable construction.

It is yet another object of the present invention to provide a collapsible fuel container can which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
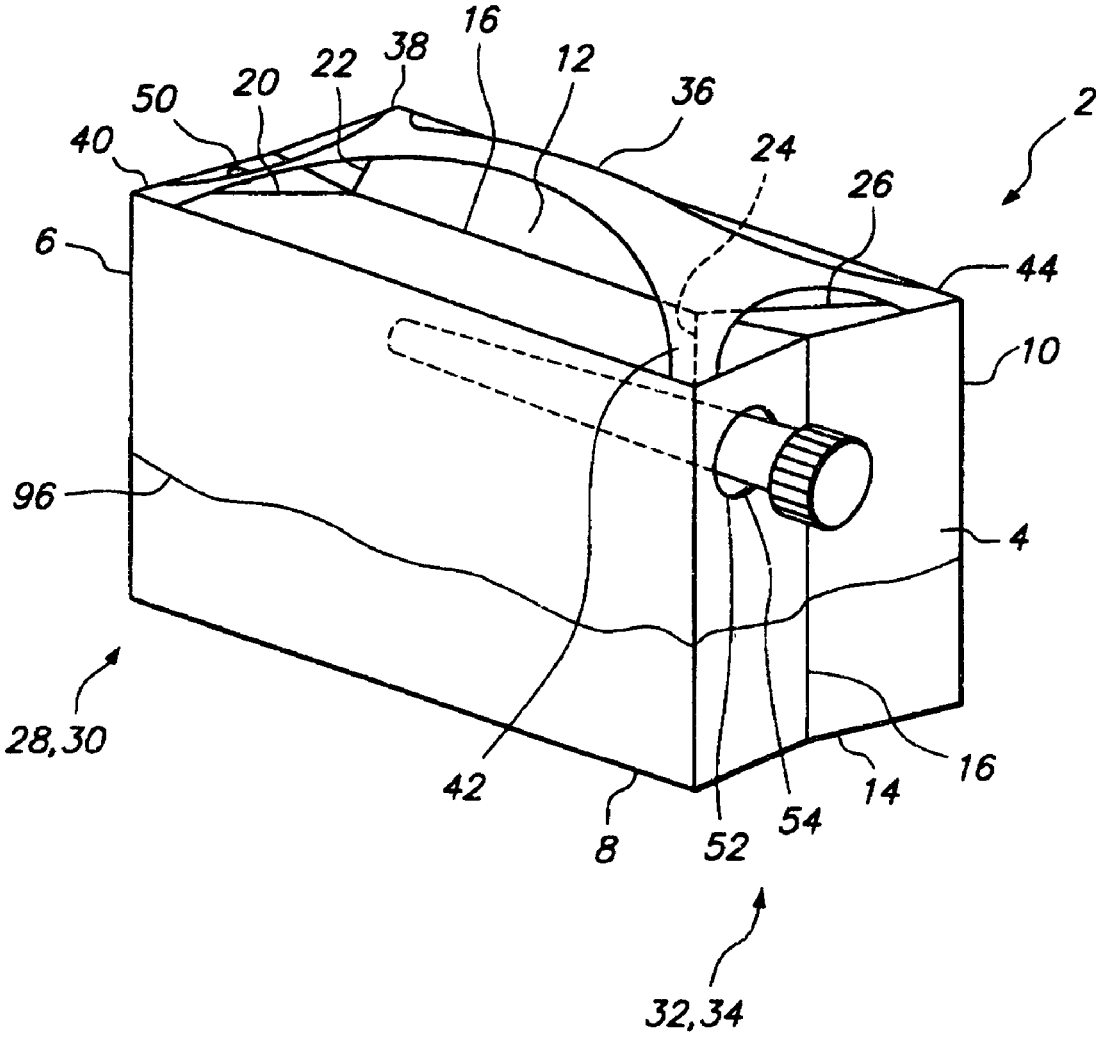
FIG. 1 shows a top perspective view of the collapsible fuel container.
Figure 2:
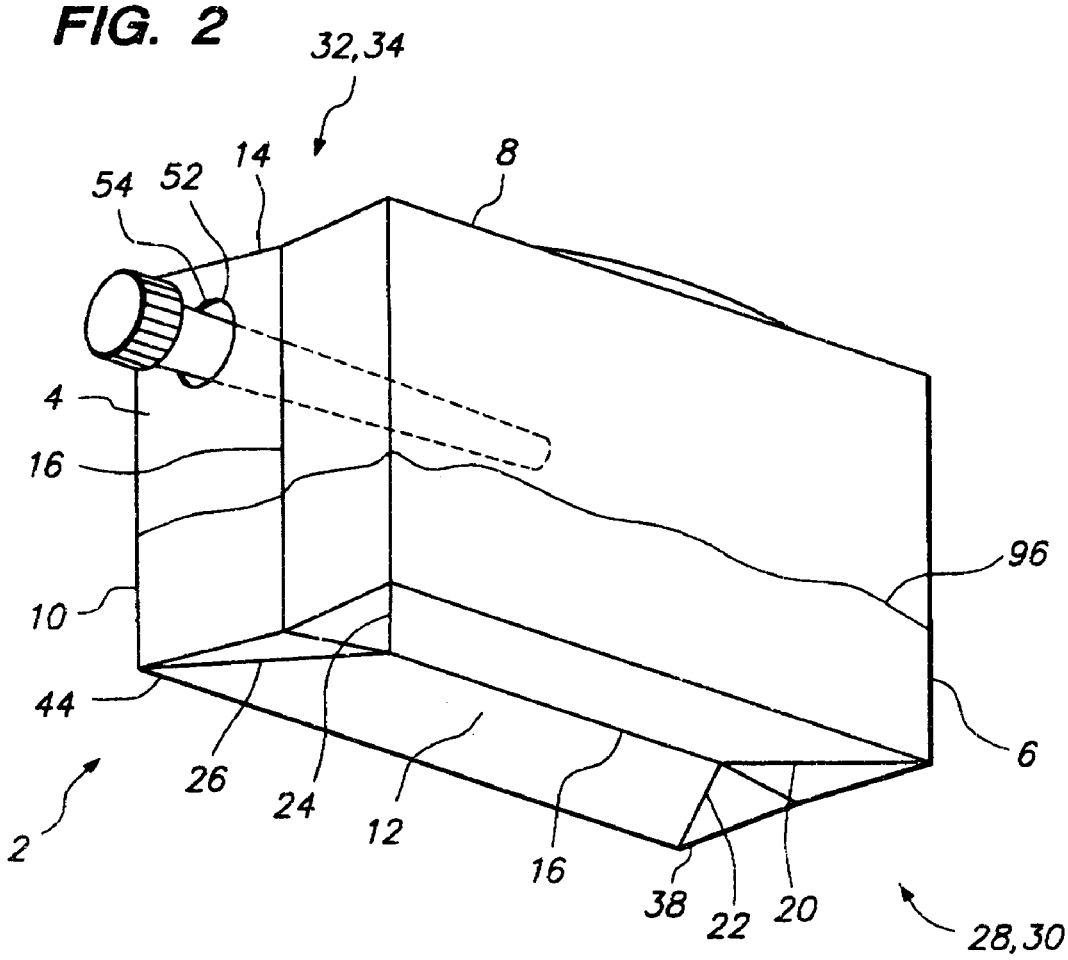
FIG. 2 shows a bottom perspective view of the collapsible fuel container.

FIG. 1 shows a top perspective view of the collapsible fuel container 2, while FIG. 2 shows a bottom perspective view of the collapsible fuel container 2. Container 2 comprises an outer casing 3 that has two ends, a front end 4 and a rear end 6, two sides, a first side 8 and a second side 10, and two surfaces, a top surface 12 and a bottom surface 14.

The top surface 12 of the outer casing 3 has a central fold line 16 that allows the container 2 to be essentially folded by compacting it up. This central fold line 16 extends downward toward the front end 4 and the rear end 6 of the outer casing 3 and also is located on the bottom surface 14 of the outer casing 3. The central fold line 16 extends inward at most locations where it is located when an individual folds the outer casing 3 by pushing together the first side 8 and the second side 10 of the outer casing 3.

Connected to the central fold line 16 on both the top surface 12 and the bottom surface 14 are a variety of diagonal fold lines that assist in folding the container 2 inward as compact as possible. Located on the top surface 12 of the outer casing 3 near the rear end 6 of the container are fold lines 20 and 22, while located on the top surface 12 of the outer casing 3 near the front end 4 of the outer casing 3 are fold lines 24 and 26. Located on the bottom surface 14 of the outer casing 3 near the rear end 6 of the container are fold lines 28 and 30, while located on the bottom surface 14 of the outer casing 3 near the front end 4 of the outer casing 3 are fold lines 32 and 34.

FIGS. 1 and 2 also show handle 36, which has two ends, a first end and a second end. Each of the ends has a pair of connectors. First end of handle 36 has connectors 38 and 40, while second end of handle 36 has connectors 42 and 44. Connector 38 on the first end of the handle 36 is connected to a corner where the top surface 12, rear end 6, and second side 10 of the outer casing 3 meet. Connector 40 on the first end of the handle 36 is connected to a corner where the top surface 12, rear end 6, and first side 8 of the outer casing 3 meet. Connector 42 on the second end of the handle 36 is connected to a corner where the top surface 12, front end 4, and first side 8 of the outer casing 3 meet. Connector 44 on the second end of the handle 36 is connected to a corner where the top surface 12, front end 6, and second side 10 of the outer casing 3 meet.

Outer casing 3 also has a top-mounted air vent 50 located on the top surface 12 of the outer casing 3 and has a hole 52 located on the front end 4 of the container. Hole 52 has a plurality of internal threads 54 around its inner circumference. A volume of fuel 96 can be seen within the outer casing 3.

Figure 3:
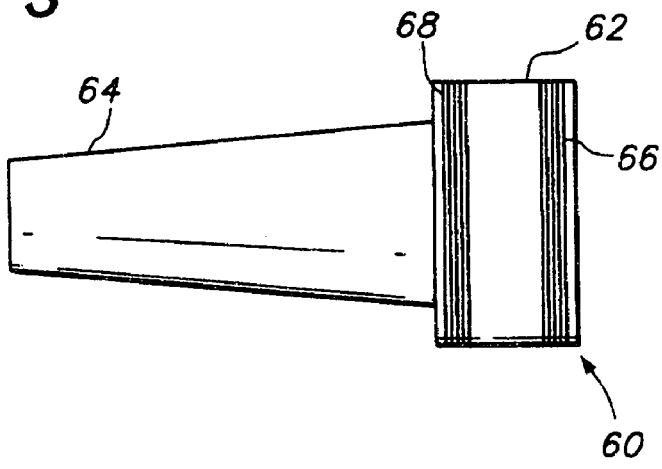
FIG. 3 shows a side view of the fuel filler spout used with the collapsible fuel container.

FIG. 3 shows a side view of the fuel filler spout 60 used with the collapsible fuel container. Spout 60 has two ends, a first end and a second end.

The first end of spout 60 has a connector nodule 62 that has two ends, a first end and a second end. The first end of the connector nodule 62 is the same as the first end of the spout 60. Connector nodule 62 has a circular cross-sectional shape and has a perimeter.

Connected to the second end of the connector nodule 62 is a tube 64 which has two ends, a first end and a second end. The first end of the tube 64 is connected to the second end of the connector nodule 62.

Spout 60 has two separate pairs of external threads comprising a first pair of external threads 66 and a second pair of external threads 68. The first pair of external threads 66 surrounds the perimeter of the connector nodule 62 right at the first end of the connector nodule 62, while the second pair of external threads 68 surrounds the perimeter of the connector nodule 62 right at the second end of the connector nodule 62.

If an individual wants to use the container 2 to pour out a volume of fuel 96 within the container, the user would threadably attached the first pair of external threads 66 to the plurality of internal threads 54 around its inner circumference of the hole 52. This would cause the tube 64 of the spout 60 to stick outside the container 2, allowing the fuel 96 to be poured where desired without major spillage.

If an individual wants to place a volume of fuel 96 into the container 2, the user would threadably attached the second pair of external threads 68 to the plurality of internal threads 54 around its inner circumference of the hole 52. This would cause the tube 64 of the spout 60 to be located inside the container 2, allowing the fuel 96 to be inserted into the container 2 easily with a very minimal, if any, amount of spillage.

What I claim as my invention is:

1. A collapsible fuel container comprising:

(a) an outer casing having two ends, a front end and a rear end, the outer casing also having two sides, a first side and a second side, the outer casing also having two surfaces, a top surface and a bottom surface, (b) a central fold line on the top surface of the outer casing, the central fold line extends downward toward the front end and the rear end of the container, the central fold line also being located on the bottom surface of the container, (c) a plurality of diagonal fold lines connected to the central fold line, the plurality of diagonal fold lines being located on either the top surface or the bottom surface of the container, (d) a handle having two ends, a first end and a second end, each end of the handle having a pair of connectors, wherein each of the connectors is connected to a corner on the top surface of the outer casing, (e) an air vent located on the top surface of the outer casing, (f) a hole located on the front end of the outer casing, (g) a volume of fuel located within the outer casing, (h) a fuel filler spout having two ends, a first end and a second end, the fuel filler spout further comprising a connector nodule that has two ends, a first end and a second end, the fuel filler spout further comprising a tube which has two ends, a first end and a second end, the first end of the tube being connected to the second end of the connector module, (i) means for removably connecting the fuel filler spout to the hole located on the front end of the outer casing, (j) wherein the outer casing could be collapsed as long as the volume of fuel located within the outer casing is evacuated prior to collapsing the outer casing.

2. A collapsible fuel container according to claim 1 wherein the plurality of diagonal fold lines connected to the central fold line numbers at least eight diagonal fold lines, further wherein at least two of the diagonal fold lines are located on the top surface of the outer casing near the rear end of the container, further wherein at least two of the diagonal fold lines are located on the top surface of the outer casing near the front end of the container, further wherein at least two of the diagonal fold lines are located on the bottom surface of the outer casing near the rear end of the container, and further wherein at least two of the diagonal fold lines are located on the bottom surface of the outer casing near the front end of the container.

3. A collapsible fuel container according to claim 2 wherein the means for removably connecting the fuel filler spout to the hole located on the front end of the outer casing further comprises:

(a) a plurality of internal threads within the hole, (b) a first plurality of external threads located around the perimeter of the connector module at the first end of the connector module, (c) a second plurality of external threads located around the perimeter of the connector module at the second end of the connector module, (d) wherein an individual can mate one of the pluralities of external threads with the plurality of internal threads within the hole to removably connecting the fuel filler spout to the hole.

* * * * *